US008721112B2

(12) United States Patent
Hetrick et al.

(10) Patent No.: US 8,721,112 B2
(45) Date of Patent: May 13, 2014

(54) EXTERNAL MECHANICAL BATTERY DISCONNECT FOR EMERGENCY LIGHTING PRODUCTS

(71) Applicants: Westly Davis Hetrick, Atlanta, GA (US); Daniel Leland Bragg, Peachtree City, GA (US)

(72) Inventors: Westly Davis Hetrick, Atlanta, GA (US); Daniel Leland Bragg, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/780,328

(22) Filed: Feb. 28, 2013

(65) Prior Publication Data

US 2013/0229782 A1 Sep. 5, 2013

Related U.S. Application Data

(63) Continuation of application No. 12/633,612, filed on Dec. 8, 2009, now Pat. No. 8,388,170.

(51) Int. Cl.
*F21L 4/00* (2006.01)

(52) U.S. Cl.
USPC ..... 362/208

(58) Field of Classification Search
USPC ..... 362/208, 20, 146–148, 157–158, 362/183–184, 362, 368, 375, 812
See application file for complete search history.

(56) References Cited

U.S. PATENT DOCUMENTS

| | | | |
|---|---|---|---|
| 5,446,440 | A | 8/1995 | Gleason et al. |
| 5,461,550 | A | 10/1995 | Johnstone |
| 5,768,814 | A | 6/1998 | Kozek et al. |
| 5,811,938 | A | 9/1998 | Rodriguez |
| 6,339,296 | B1 | 1/2002 | Goral |

*Primary Examiner* — Vip Patel
(74) *Attorney, Agent, or Firm* — King & Spalding LLP

(57) ABSTRACT

An emergency lighting device includes an internal battery, a switching mechanism, and one or more light sources. The light sources are electrically coupled to the internal battery through the switching mechanism. The switching mechanism includes a first contact and a second contact. Additionally, the switching mechanism is configured to receive an external mechanical disconnect male jack to electrically disconnect the light sources from the internal battery. In certain embodiments, the emergency lighting device is also electrically coupled to an external power source and includes a circuit breaker for providing power to the light sources from the external power supply during normal operation and for automatically providing power to the light sources from the internal battery in the event that power from the external power source fails.

20 Claims, 8 Drawing Sheets

EXTERNAL MECHANICAL BATTERY DISCONNECT FOR EMERGENCY LIGHTING PRODUCTS

CROSS-REFERENCE TO RELATED APPLICATIONS

This patent application is a continuation of and claims priority under U.S.C. §120 to U.S. patent application Ser. No. 12/633,612, entitled "External Mechanical Battery Disconnect For Emergency Lighting Products," filed Dec. 8, 2009, the entirety of which is incorporated by reference herein.

TECHNICAL FIELD

The present invention relates generally to emergency lighting devices and more particularly, to emergency lighting devices having an internal battery capable of being disconnected externally.

BACKGROUND

Conventional emergency lighting devices are relied on during emergency situations, such as power outages. One example of an emergency lighting device is an exit sign. Under some government codes, these emergency devices are required to exhibit a specific amount of illumination and have an emergency backup power source to provide illumination for a specified period of time when electrical power to the device is interrupted. These conventional emergency lighting devices include circuitry that illuminates emergency lights during a power outage using an internal battery or similar power supply.

Typically emergency lighting devices are thoroughly tested at the factory to ensure that they will function properly once installed. To test the emergency lighting device at the factory, the emergency lighting device is completely assembled. The circuitry is then coupled to a testing machine to ensure proper functioning. Upon successful testing of the circuitry, the device's battery is disconnected from the circuitry so that the battery's charge is not reduced below an acceptable level prior to installation. The emergency lighting device is then sent from the factory.

One problem with conventional emergency lighting devices is that they are time consuming to install because they are not shipped from the factory in a condition that is ready for immediate installation. When an installer or electrician installs the device, the typical procedure is to install the device, remove a portion of the housing, plug in the battery, energize the circuit breaker to test the circuitry, de-energize the circuit breaker, disconnect the battery, replace the portion of the housing, wait for building inspection, remove the portion of the housing, plug in the battery again, energize the circuit breaker, and replace the portion of the housing.

In view of the foregoing, there is a need in the art for providing an emergency lighting device that is easier and faster to install. Additionally, there is a need in the art for providing an emergency lighting device that is installable without need for disassembly during the inspection phase. There is a further need in the art for providing an emergency lighting device that has a battery physically, but not electrically, coupled with the device's circuitry, to prevent loss of charge prior to installation. Furthermore, there is a need for providing a simpler method for installing the emergency lighting device.

SUMMARY

According to one exemplary embodiment, an emergency lighting device can include a housing that can further include a battery, a switching mechanism, and one or more light sources. The switching mechanism can be electrically coupled to the battery. The light sources can be electrically coupled to the internal battery through the switching mechanism. The switching mechanism can receive a plug that electrically disconnects the light sources from the battery.

According to another exemplary embodiment, an emergency lighting device can include a housing that can further include a battery, a switching mechanism, one or more light sources, and a circuit breaker. The switching mechanism can be electrically coupled to the battery. The light sources can be electrically coupled to the battery through the switching mechanism and can also be electrically coupled to an external power source. The circuit breaker can be electrically coupled to the battery and to the external power source. The circuit breaker can be electrically positioned upstream of the one or more light sources and downstream of the battery, the switching mechanism, and the external power source. The circuit breaker can provide power to the light sources from the external power supply during normal operation and can automatically provide power to the light sources from the internal battery in the event of power failure from the external power source. The switching mechanism can receive an external plug to electrically disconnect the light sources from the battery.

According to another exemplary embodiment, a method for installing an emergency lighting device can include mounting an emergency lighting device onto a mounting structure, electrically coupling the emergency lighting device to an external power source, and removing an external plug from a switching mechanism to enable operation of a back-up power source. The emergency lighting device can include a housing and an external plug. The housing can include a battery, a switching mechanism, and one or more light sources. The battery can provide a back-up power source. The switching mechanism can be electrically coupled to the battery. The light sources can be electrically coupled to the battery through the switching mechanism. The external plug can be releasably coupled to the switching mechanism.

BRIEF DESCRIPTION OF THE DRAWINGS

The foregoing and other features and aspects of the invention are best understood with reference to the following description of certain exemplary embodiments, when read in conjunction with the accompanying drawings, wherein.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to emergency lighting devices having a battery capable of being disconnected externally. Although the description of exemplary embodiments is provided below in conjunction with exit signs, alternate embodiments of the invention may be applicable to other types of emergency lighting devices that have a battery installed within the device. Additionally, although the description of exemplary embodiments is provided below in conjunction with light emitting diodes (LEDs) in an exit sign, alternate embodiments of the invention is applicable to other types of light sources in an emergency lighting device including, but not limited to, incandescent lamps, fluorescent lamps, compact fluorescent lamps, organic light emitting diodes, high intensity discharge ("HID") lamps, or a combination of lamp types known to persons of ordinary skill in the art.

Figure 1A:
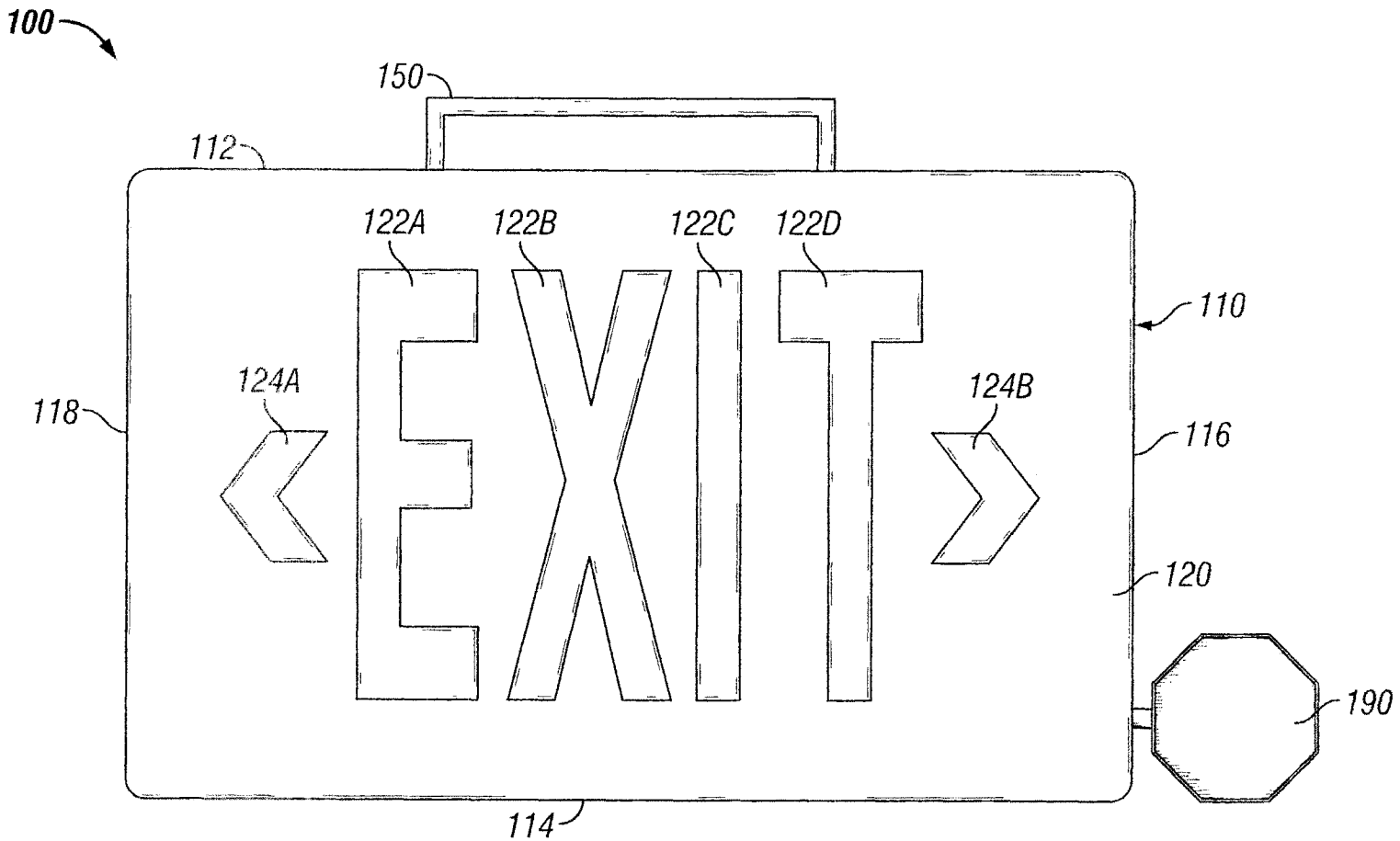
FIG. 1A is a front elevation view of an assembled exit sign in accordance with an exemplary embodiment of the present invention.
Figure 1B:
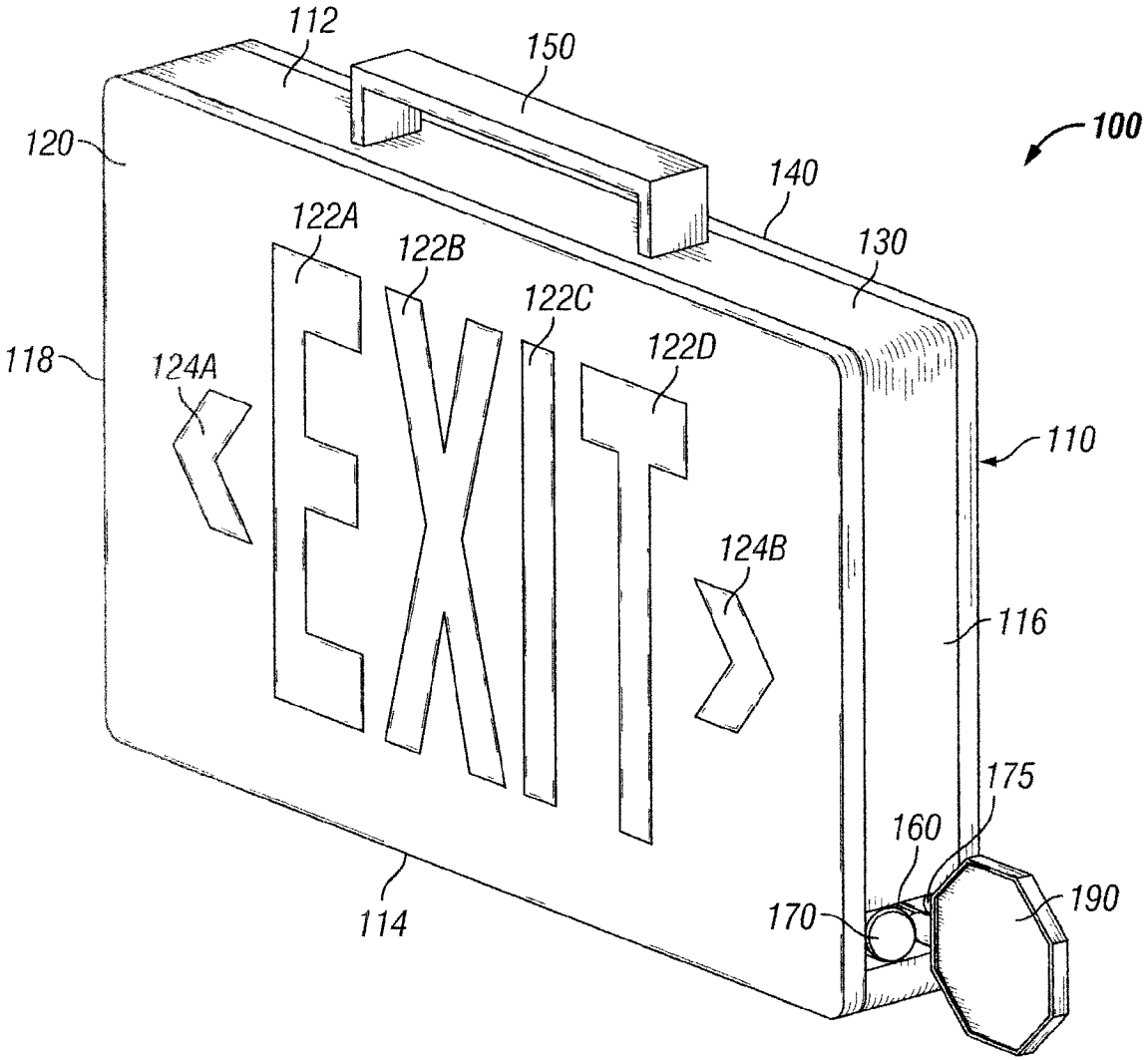
FIG. 1B is a perspective view of the exit sign of FIG. 1A in accordance with an exemplary embodiment of the present invention.

The invention is better understood by reading the following description of non-limiting, exemplary embodiments with reference to the attached drawings, wherein like parts of each of the figures are identified by like reference characters, and which are briefly described as follows. FIG. 1A is a front elevation view of an assembled exit sign 100 in accordance with an exemplary embodiment of the present invention. FIG. 1B is a perspective view of the assembled exit sign 100 of FIG. 1A in accordance with an exemplary embodiment of the present invention. Referring to FIGS. 1A and 1B, the assembled exit sign 100 includes a housing 110, a canopy 150 coupled to the housing 110, and a switching mechanism access opening 160 formed at an exterior surface of the housing 110.

The housing 110 includes a front panel 120, a frame 130, and a rear panel 140, which collectively form the housing's top edge 112, bottom edge 114, first side edge 116, and second side edge 118. While the front panel 120 in this exemplary embodiment is substantially rectangular, the front panel 120 can be any geometric or non-geometric shape without departing from the scope and spirit of the exemplary embodiment. The front panel 120 is removably coupled to the frame 130 using fasteners, clips, snap fittings, screws, or any other coupling device or method known to people having ordinary skill in the art. The exemplary front panel 120 is generally non-transparent and includes four light passageway openings 122A, 122B, 122C, and 122D that define the four letters, or four indicia, in capitalized mode of the word "EXIT", respectively, that extend horizontally in the middle area of the front panel 120. Light beams projected from one or more LEDs 230 (FIG. 2A) pass through each light passageway opening 122A, 122B, 122C, and 122D for eventual viewing by an observer. Although four light passageway openings 122A, 122B, 122C, and 122D are illustrated, any number of light passageway openings are employable for illustrating any other word, symbol, or illustration without departing from the scope and spirit of the exemplary embodiment. In one exemplary embodiment, the front panel 120 optionally includes two additional light passageway openings that define directional symbols, namely, opposed chevron arrow openings 124A and 124B through which light beams projected from the LEDs 230 (FIG. 2A) also pass. In an alternative embodiment, the front panel 120 is clear and translucent, but at least some portions thereof are made non-translucent by a manner known in the art, such as by the application of paint or another masking medium.

The exemplary frame 130 is substantially rectangular and is configured to be coupled to the front panel 120 and the rear panel 140. However, in alternative embodiments the frame 130 is capable of being any geometric or non-geometric shape without departing from the scope and spirit of the exemplary embodiment. According to the exemplary embodiment of FIGS. 1A and 1B, the frame 130 includes a canopy 150 coupled to the frame's top edge. In one exemplary embodiment, the canopy 150 provides support for coupling the exit sign 100 to a ceiling or wall structure (not shown). Alternatively, in lieu of or in addition to the canopy 150, other mounting devices known to people of ordinary skill in the art are incorporated into or used in conjunction with the frame 130 to mount the exit sign 100 to a ceiling, mounting pole, wall, or other mounting structures.

Figure 2A:
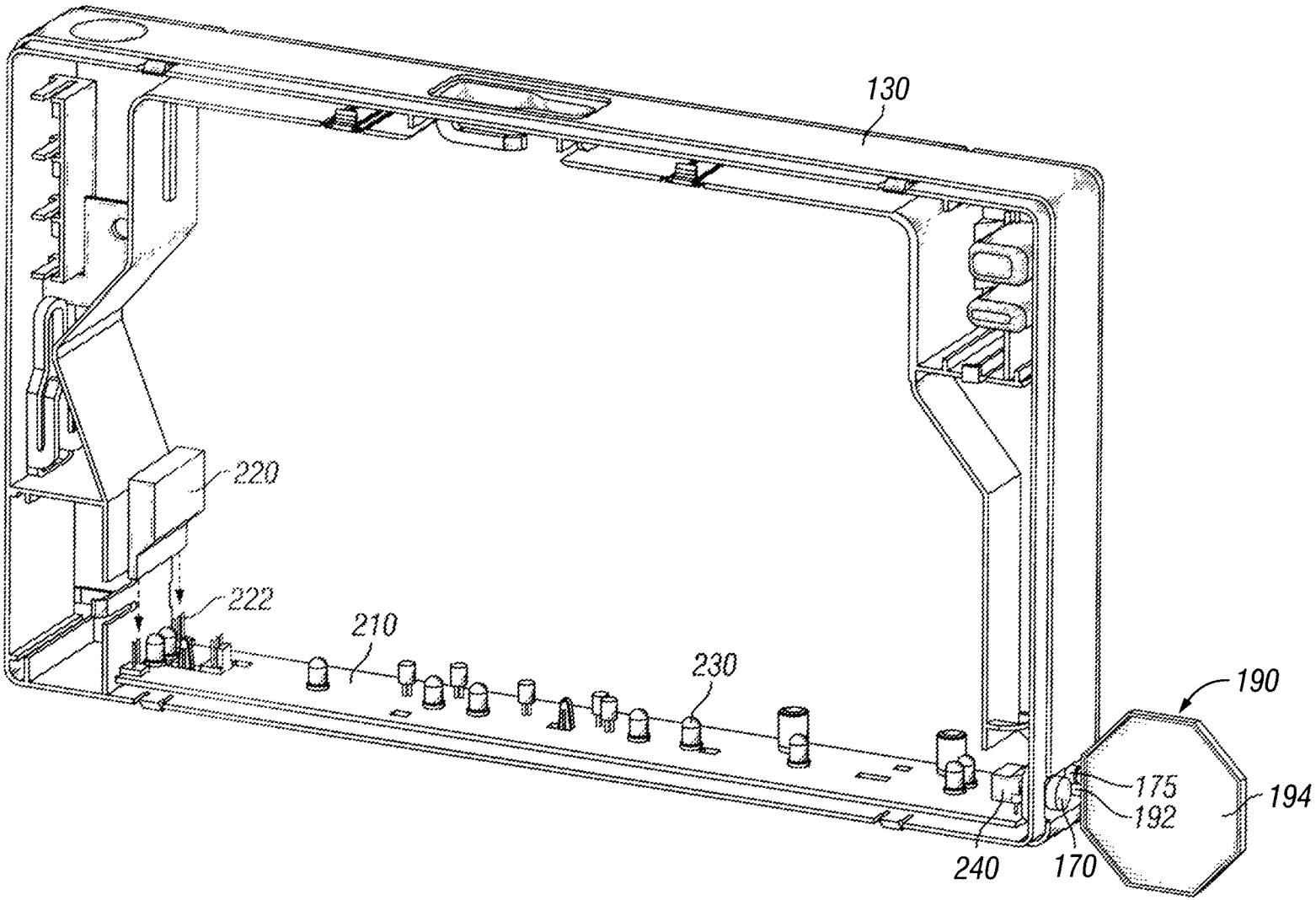
FIG. 2A is a perspective view of a frame of the exit sign with a mechanical disconnect male jack coupled to the frame in accordance with an exemplary embodiment of the present invention.

The frame 130 also includes the switching mechanism access opening 160. In one exemplary embodiment, the opening 160 is formed at the frame's side edge towards its lower area. Alternatively, the switching mechanism access opening 160 is capable of being formed anywhere along the housing's exterior surface, adjacent the switching mechanism 240 (FIG. 2A), without departing from the scope and spirit of the exemplary embodiment. The switching mechanism access opening 160 extends from the frame's exterior surface towards the frame's interior surface. The switching mechanism access opening 160 allows visual and/or physical access to the switching mechanism 240 (FIG. 2A). The switching mechanism 240 (FIG. 2A) receives at least a portion of the mechanical disconnect male jack 190 to mechanically break (or disconnect) the electrical path between the removable internal battery 220 (FIG. 2A) and the LEDs 230 (FIG. 2A). Mechanically breaking the electrical path prevents the internal battery 220 (FIG. 2A) from discharging power to the LEDs 230 (FIG. 2A). As illustrated in FIG. 1B, the DC power disconnect test switch 170 and the DC power indicator 175 are positioned adjacent to the switching mechanism access opening 160. The function of the DC power disconnect test switch 170 is to test the proper functionality of the internal battery 220 (FIG. 2A) by simulating the interruption of DC voltage power when pressed inwardly. The function of the DC power indicator 175 is to signal the presence of AC voltage power. In one exemplary embodiment, the DC power indicator 175 is and LED.

In one exemplary embodiment, the rear panel 140 is substantially rectangular and is removably coupled to the frame 130 opposite the front panel 120. Alternatively, the rear panel 140 is modifiable to any geometric or non-geometric shape without departing from the scope and spirit of the exemplary embodiment. The rear panel 140 is removably coupled to the frame 130 using fasteners, clips, snap fittings, screws, or any other coupling devices or method known to people having ordinary skill in the art. The rear panel 140 is generally non-transparent. Although, both the front panel 120 and the rear panel 140 are removable, alternative exemplary embodiments provide for only one of them being removable.

In alternative embodiments, the rear panel 140 is similar to the embodiments as described for the front panel 120. In one alternative embodiment, the rear panel 120 is generally non-transparent and include one or more light passageway openings that illustrate any word, symbol, or illustration without departing from the scope and spirit of the exemplary embodiment. In another alternative embodiment, the rear panel 140 is clear and translucent, but is made non-translucent by a manner known in the art, such as by the application of paint or other masking medium.

Figure 2B:
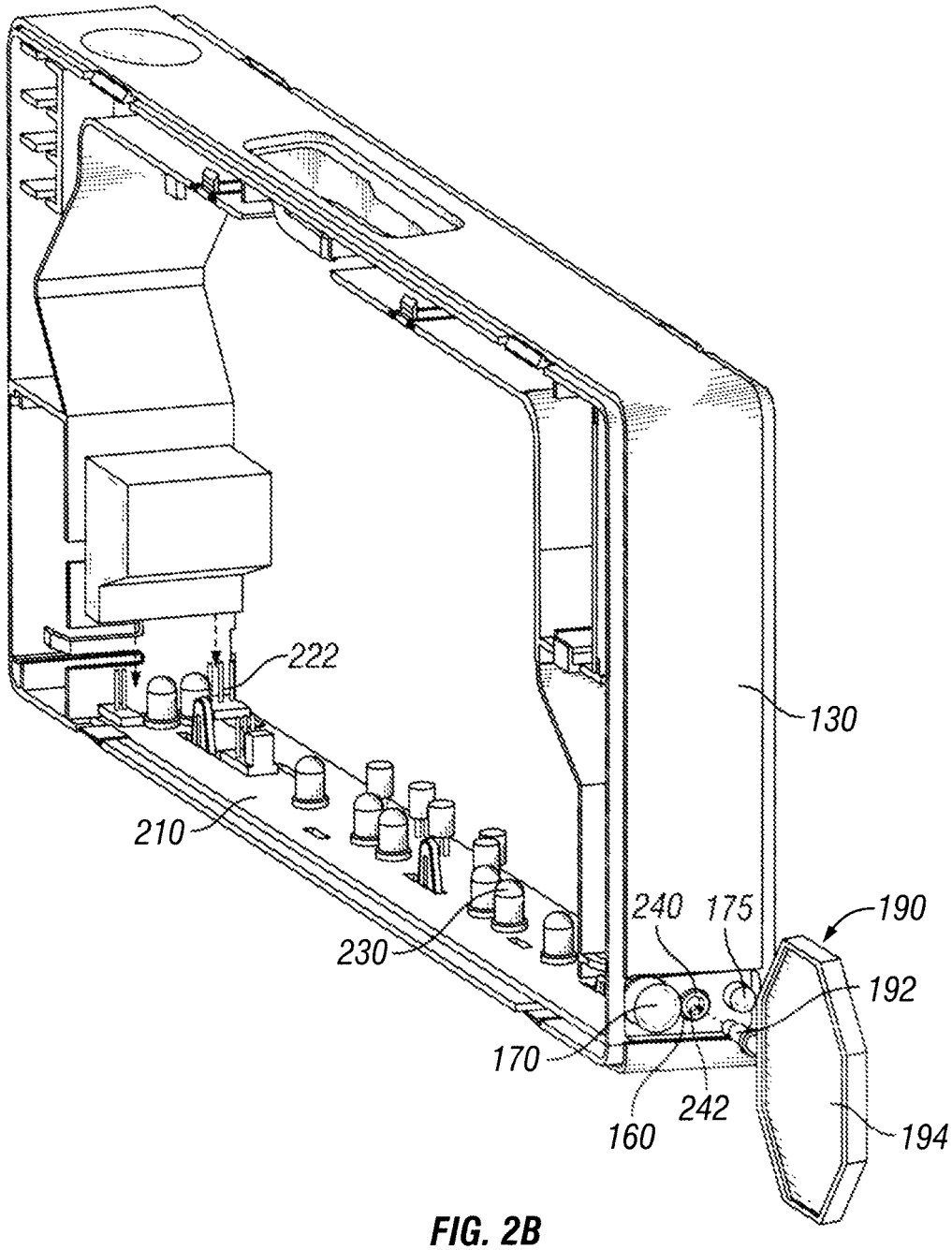
FIG. 2B is a perspective view of the frame of FIG. 2A with the mechanical disconnect male jack decoupled from the frame in accordance with an exemplary embodiment of the present invention.

FIG. 2A is a perspective view of the exit sign 100 with a mechanical disconnect male jack 190 coupled to the frame 130 in accordance with an exemplary embodiment of the present invention. FIG. 2B is a perspective view of the frame 130 of FIG. 2A with the mechanical disconnect male jack 190 decoupled from the frame 130 in accordance with an exemplary embodiment of the present invention. Now referring to FIGS. 2A and 2B, the frame 130 includes a circuit board 210 having an internal battery 220, one or more LEDs 230, a DC power disconnect test switch 170, a DC power indicator 175, and a switching mechanism 240. In one exemplary embodiment the battery 220, LEDs 230 switch 170, indicator 175, and switching mechanism 240 are electrically coupled to the circuit board 210. In one exemplary embodiment, the circuit board 210 is positioned at least across a portion of the bottom edge of the interior surface of the frame; however, those of ordinary skill in the art will recognize that the circuit board 210 is positionable anywhere within the housing 110 without departing from the spirit and scope of the exemplary embodiment. The circuit board 210 includes several electrical components that are electrically coupled together by traces (not shown). The exemplary circuit board 210 is fabricated using conducting layers and insulating layers, wherein the conducting layers are typically made of thin copper foil and the insulating layers are made of a dielectric material. Some examples of potential dielectric layers used for the circuit board 210 include, but are not limited to, polytetrafluoroethylene, FR-4, FR-1, CEM-1, or CEM-3.

The internal battery 220 is electrically coupled to the circuit board 210 using one or more battery plugs 222, which are optionally disposed on the circuit board 210. Once the internal battery 220 has been electrically coupled to the battery plugs 222, the internal battery 220 is electrically coupled to the electrical circuit (not shown) on the circuit board 220. According to this exemplary embodiment, the internal battery 220 is a rechargeable battery. Alternatively, the internal battery 220 is any suitable device capable of storing power and providing that power to the LEDs 230 during power outages or other emergency situations. Suitable internal batteries 220 include rechargeable batteries, dry cell batteries, lead acid batteries, other types of batteries, or any other suitable storage device presently existing or made available in the future.

The LEDs 230 are electrically coupled to, and in one exemplary embodiment, mounted onto, the circuit board 210. The LEDs 230 provide light sources that emit light through portions of the front panel 120. During normal operations, the LEDs 230 are supplied power from an external power source (not shown). During a power interruption of the external power source, the internal battery 220 supplies back-up power to the LEDs 230 so that the LEDs 230 can function continuously without interruption. The internal battery 220 is designed to provide emergency back-up power for a predetermined time period. The LEDs 230 will be powered by the internal battery 220 until either the power from the external power source is restored or the charge on the internal battery 220 is depleted. Although FIG. 2A illustrates ten LEDs 230, this number is exemplary only and greater or fewer numbers of LEDs 230 are within the scope and spirit of the exemplary embodiment. According to some exemplary embodiments, the LEDs 230 emit light in only one color. However, in alternative embodiments, the LEDs 230 emit light in two or more different colors. In the embodiments with two or more different colored LEDs 230, the LEDs of one color can operate simultaneously with the LEDs of another color or the LEDs of one color can operate in lieu of the LEDs of another color.

The DC power disconnect test switch 170 is electrically coupled to the circuit board 210. In one exemplary embodiment, the switch 170 is electrically coupled to a portion of the circuit board 210 that is opposite that where the internal battery 220 is electrically coupled. In the alternative, the DC power disconnect test switch 170 is capable of being electrically coupled anywhere on the circuit board 210 or anywhere in the housing without departing from the scope and spirit of the exemplary embodiment. In this exemplary embodiment, the DC power disconnect test switch 170 is positioned upstream in the circuitry on the circuit board 210 from the circuitry located between the internal battery 220 and the LEDs 230. The function of the DC power disconnect test switch 170 is to test the electronic of the backup system to internal battery 220 by simulating the interruption of DC voltage power that is eventually generated from the external power source. A portion of the DC power disconnect test switch 170 is accessible from the exterior of the frame 130 so that a user can operate the DC power disconnect test switch 170 when desired. Upon testing this backup system and determining that the LEDs 230 are not functioning, the user can replace the internal battery 220.

The DC power indicator 175 is also electrically coupled to the circuit board 210. In one exemplary embodiment, the indicator 175 is electrically coupled along another end of the circuit board 210 opposite the end where the exemplary internal battery 220 is electrically coupled. However, as with the other components, the DC power indicator 175 can be electrically coupled anywhere on the circuit board 210 or anywhere in the housing 110 without departing from the scope and spirit of the exemplary embodiment. In one exemplary embodiment, the DC power indicator 175 is positioned downstream in the circuitry from the DC power disconnect test switch 170 but parallel to the circuitry between the internal battery 220 and the LEDs 230. The function of the DC power indicator 175 is to signal the presence of AC voltage power. At least a portion of the DC power indicator 175 is viewable to an observer so that the observer is able to determine whether there is a presence of AC voltage power to the circuit board 210. When the DC power indicator 175 is not lit, it indicates that AC voltage power is not supplied to the circuit board. Hence, if the LEDs 230 are lit up when the DC power indicator 175 is not lit, the internal battery 220 is supplying the necessary power to the LED 230 since there is no AC power being supplied to the circuit board 210. However, if the LEDs 230 are not lit, either the internal battery 220 is not properly functioning and may need replacement or the circuitry between the internal battery 220 and the LEDs 230 has malfunctioned.

Figure 3A:
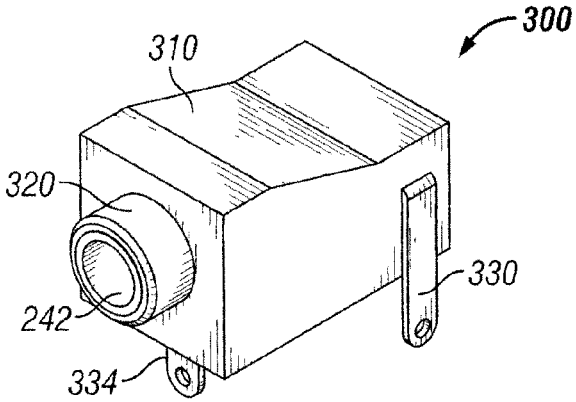
FIG. 3A is a perspective view of an audio jack presented in FIG. 2A in accordance with an exemplary embodiment of the present invention.
Figure 3B:
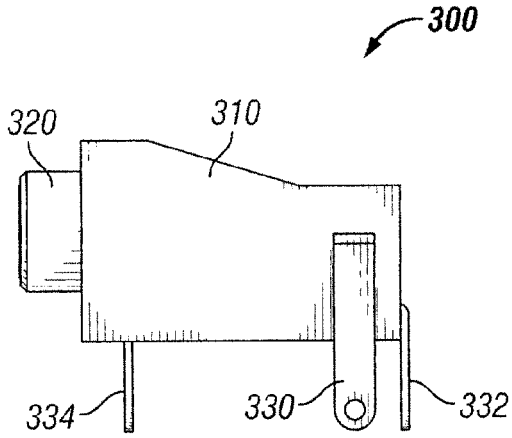
FIG. 3B is a side elevation view of the audio jack of FIG. 3A in accordance with an exemplary embodiment of the present invention.

The switching mechanism 240 is also electrically coupled to the circuit board 210. In one exemplary embodiment, the switching mechanism 240 is electrically coupled at the end of the circuit board 210 opposite the end where the internal battery 220 is electrically coupled. In this exemplary embodiment, the switching mechanism 240 is electrically coupled between the DC power indicator 175 and the DC power disconnect test switch 170. Alternatively, the switching mechanism 240 is capable of being electrically coupled anywhere on the circuit board 210 or anywhere in the housing 110 so long as the switching mechanism 240 is positioned adjacent the switching mechanism access opening 160 without departing from the scope and spirit of the exemplary embodiment. In one exemplary embodiment, the switching mechanism 240 is positioned downstream in the circuitry from the internal battery 210 and upstream of the LEDs 230. The switching mechanism 240 provides an external electrical disconnect within the circuitry between the internal battery 220 and the LEDs 230 so that the battery 220 does not discharge to below acceptable levels prior to the exit sign 100 being installed. The switching mechanism 240 includes a female receptacle 242 that is accessible from the frame's exterior so that at least a portion of the mechanical disconnect male jack 190 is insertable therein. According to one exemplary embodiment, the switching mechanism 240 is a mono audio jack 300 (FIGS. 3A and 3B). Alternatively, the switching mechanism includes any device, such as a phone jack, that is normally closed and becomes open once an object is inserted within the device without departing from the scope and spirit of the exemplary embodiment.

As illustrated in FIG. 2A, a portion of the mechanical disconnect male jack 190 is inserted within the female receptacle 242 of the switching mechanism 240 to electrically disconnect the circuitry between the internal battery 220 and the LEDs 230. This feature is called an external disconnect feature. In this position, the internal battery 220 does not discharge electrical energy to the LEDs 230. The circuit breaker is de-energized when the mechanical disconnect male jack 190 is inserted within the switching mechanism 240. This switching mechanism 240 and insertion of the mechanical disconnect male jack 190 within the switching mechanism 240 allows the internal battery 220 to be installed in the exit sign 100 and mechanically coupled to the circuit board 210 prior to purchase. Installation is easier and quicker because the exit sign 100 does not have to be disassembled to install the internal battery 220. Additionally, the exit sign 100 does not have to be disassembled to de-energize the circuit breaker for building inspection, but instead, the circuit is de-energized by using the external disconnect feature. Once the mechanical disconnect male jack 190 is removed from the female receptacle 242, as shown in FIG. 2B, the circuitry between the internal battery 220 and the LEDs 230 is electrically recoupled and the internal battery 220 is able to provide electrical power to the LEDs 230 if the AC power source fails.

The exemplary mechanical disconnect male jack 190 includes a plug end 192 that is insertable into the female receptacle 242 of the switching mechanism 240. In the exemplary embodiment, the plug end 192 is fabricated from plastic. However, in alternative embodiments, the plug end 192 is fabricated from any suitable non-conducting material including, but not limited to, paper, wood, and fish paper without departing from the scope and spirit of the exemplary embodiment. In still other exemplary embodiments, the plug end 192 is fabricated from conducting and non-conducting materials, wherein at least a portion of the non-conducting material is inserted into the female receptacle 242 to break the electrical connection within the switching mechanism 240. For example, a plug end 192 fabricated from conducting material is surrounded or sheathed by a non-conducting material. Optionally, the plug end 192 is coupled to a sign 194. According to one exemplary embodiment, the sign 194 is fabricated from the same material as the plug end 192. Alternatively, the sign 194 is fabricated from either non-conducting material, conducting material, or a combination of both conducting and non-conducting materials. The exemplary sign 194 is alternatively a physical representation of its function, for example, a "Stop Sign", a written representation of its function, for example, the words "Stop: Battery Disconnected", a device that is easier for a user grasp, or any combination thereof.

Figure 4:
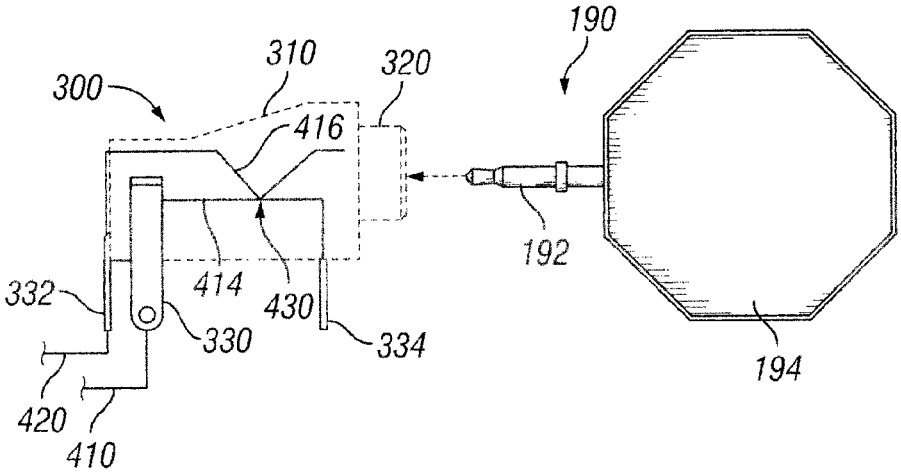
FIG. 4 is a cross-sectional view of the interaction between the audio jack of FIGS. 3A and 3B and the mechanical disconnect male jack in accordance with an exemplary embodiment of the present invention.

FIGS. 3A and 3B are views of the audio jack 300 of FIG. 2A in accordance with an exemplary embodiment of the present invention. FIG. 4 is a cross-sectional view of the interaction between the audio jack 300 and the mechanical disconnect male jack according to an exemplary embodiment of the present invention. Referring to FIGS. 3A, 3B and 4, the audio jack 300 includes an audio jack housing 310, a port 320, a first leg 330, a second leg 332, and a third leg 334. In one exemplary embodiment, the audio jack 300 is a mono audio jack.

The exemplary audio jack housing 310 is substantially rectangular and houses a first metal contact 414 and a second metal contact 416, which will be discussed in further detail below. Although this exemplary embodiment depicts the audio jack housing 310 being substantially rectangular, the audio jack housing 310 is capable of being any geometric or non-geometric shape, including, but not limited to, square, circular, triangular or trapezoidal, without departing from the scope and spirit of the exemplary embodiment. Additionally, although the exemplary audio jack housing 310 houses two metal contacts 414 and 416, alternative embodiments include more than two metal contacts housed within the audio jack housing 310 without departing from the scope and spirit of the exemplary embodiment. In one exemplary embodiment, the audio jack housing 310 is fabricated from a non-conductive material, such as a plastic.

The port 320 is substantially circular and is coupled to the audio jack housing's surface. Although the exemplary port 320 is circular, alternative embodiments of the port 320 are any geometric or non-geometric shape that securely receive the corresponding plug end 192. The port 320 securely receive the plug end 192 of the mechanical disconnect male jack 190 through the port's 320 female receptacle 242, which extends from the exterior surface of the port 320 to the interior of the audio jack housing 310. In one exemplary embodiment, there is a friction fit between the port 320 and the plug end 192 of the jack 190. Once the plug end 192 is inserted into the port 320, the plug end 192 is removable from the port 320 by applying a pulling force to the plug end 192 to overcome the friction fit. According to one exemplary embodiment, the port 320 is fabricated from the same material as the audio jack housing 310 and is generally manufactured with the audio jack housing 310 as an integral component. However, the port 320 can be fabricated separately and thereafter coupled to the audio jack housing 310. In those embodiments where the port 320 is separately manufactured, the port 320 is typically fabricated from a conducting material or a non-conducting material. Additionally, the exemplary port 320 is positioned so that the female receptacle 242 is aligned with a connection point 430, which is where the first metal contact 414 makes contact with the second metal contact 416.

The first leg 330, second leg 332, and third leg 334 are coupled to the audio jack housing 310 and make contact with either the first metal contact 414 or the second metal contact 416. The legs 330, 332, and 334 are fabricated using a conductive material, such as a metal and are used to mount the audio jack 300 to the circuit board 210 (FIG. 2A), where conductive traces (not shown) are coupled to at least two of the legs 330, 332, and 334. The audio jack 300 is mounted to the circuit board 210 in such a manner that the port 320 is aligned with the switching mechanism access opening 160 (FIG. 1A).

The audio jack 300 is mounted onto a circuit board 210 (FIG. 2A), such that the first leg 330 is coupled to a current-in trace line 410 and the second leg 332 is coupled to a current-out trace line 420. In one exemplary embodiment, the first leg 330 and third leg 334 are connected to the first metal contact 414 at its opposing ends. The second leg 332 is coupled to the second metal contact 416. The second metal contact 416 makes contact with the first metal contact 414 at the connection point 430. In certain exemplary embodiments, the first metal contact 414 and second metal contact 416 are normally closed. Opening the first metal contact 414 and second metal contact 416 is accomplished by placing a device, such as a plug or jack, through the female receptacle 242 of the port 320 so that the device extends to the connection point 430 and breaks the contact between the second metal contact 416 and the first metal contact 414. Although, the exemplary first metal contact 414 and second metal contact 416 are fabricated from a metal or metal alloy, alternatively they are fabricated from any conducting material without departing from the scope and spirit of the exemplary embodiment. Further, while the description herein relate to placing a male plug or jack into a female receptacle, it is equally possible for the plug or jack to be female and for the port or switching mechanism to have male contacts that interact with and are slidably received by the female plug or jack. Additionally, although the first leg 330, the first metal contact 414, and the third leg 334 are shown to be fabricated as individual components, the first leg 330, the first metal contact 414, and third leg 334 can be fabricated as a single component without departing from the scope and spirit of the exemplary embodiment. Similarly, although the exemplary second leg 332 and second metal contact 416 are fabricated individually, alternative embodiments of the second leg 332 and second metal contact 416 are fabricated as a single component without departing from the scope and spirit of the exemplary embodiment.

According to FIG. 4, when the mechanical disconnect male jack plug end 192 is not inserted within the audio jack 300 and the exit sign 100 has not yet been electrically coupled to an AC power source, current flows from the internal battery 220 (FIG. 2A) through the current in trace line 410 to the first leg 330, to the first metal contact 414, to the second metal contact 416, to the second leg 332, and then to the current-out trace line 420. Hence, the internal battery 220 (FIG. 2A) is slowly discharged during this time when the exit sign 100 has not been installed because its circuitry is closed and it is providing power to the LEDs 230. When the plug end 192 is inserted within the audio jack 300, current flow is prevented between the internal battery 220 (FIG. 2A) and the LEDs 230 (FIG. 2A) due to an opening in the circuit. In one exemplary embodiment, the second metal contact 416 is raised so that the second metal contact 416 does not make contact, thereby creating an open, with the first metal contact 414 and eliminating the connection point 430. Thus, once the plug end 192 is inserted within the audio jack 300, the internal battery 220 (FIG. 2A) does not discharge power to the LEDs 230 (FIG. 2A). The internal battery 220 (FIG. 2A) can now be electrically coupled to the circuit board 210 (FIG. 2A) and shipped in an installation-ready state with the plug end 192 inserted within the audio jack 300. The mechanical disconnect male jack plug end 192 can be easily inserted into and removed from the audio jack 300 any number of times.

Figure 5:
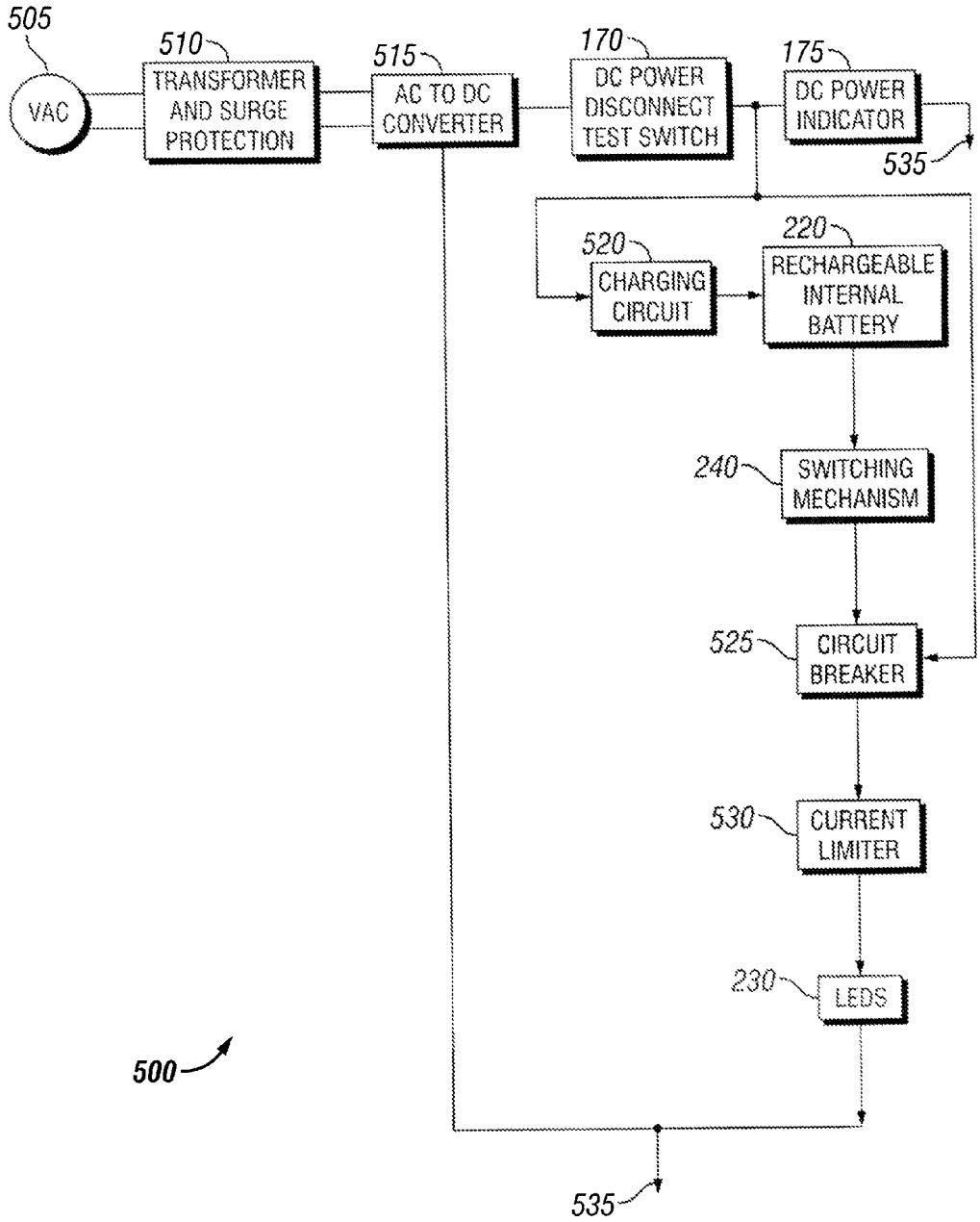
FIG. 5 is a schematic block diagram of the exit sign of FIG. 1A in accordance with an exemplary embodiment of the present invention.

FIG. 5 is a schematic block diagram 500 of the exit sign 100 of FIG. 1A in accordance with an exemplary embodiment of the present invention. Referring now to FIGS. 1-5, the usual source of power to an emergency exit sign is alternating current voltage or VAC 505. Standard AC voltages for operating the exit sign 100 include 120V, 240V, or 277V. Since the input AC voltage is high, a step-down transformer typified by step-down transformer 510 is sometimes used to bring the input voltage down to a lower operating AC voltage, for example 8 VAC. The 8 VAC is then passed through an AC/DC converter 515. In one exemplary embodiment, the AC/DC converter 515 is a bridge rectifier.

The direct current voltage or VDC is then connected to a momentary DC power disconnect test switch 170 that is normally closed. The function of DC power disconnect test switch 170 is to test the electronic circuitry of the backup system to the internal battery 220 by simulating the interruption of AC voltage power. Once the DC power disconnect test switch 170 is operated and the switch is opened, converted DC voltage from the VAC 505 to the LEDs 230 is terminated. Thus, the AC/DC converter 515 also is connected to ground 535 thereby completing the current path through the AC/DC converter 515 when the DC power disconnect test switch 170 is operated. Once the DC power disconnect test switch 170 is operated, power to the LEDs 230 is supplied from the internal battery 220. The LEDs 230 are connected to ground 535, thereby completing the current paths through LEDs 230, irrespective of whether the power is supplied by the VAC 505 or the internal battery 220.

During normal operation when the DC power disconnect test switch 170 is closed and the LEDs 230 are supplied power from the VAC 505, the DC voltage flows from the DC power disconnect test switch 170 to the DC power indicator 175, which signals the presence of AC voltage power when lit. The DC power indicator 175 is connected to ground 535 thereby completing the current path through DC power indicator 175.

Also during normal operation when the DC power disconnect test switch 170 is closed and the LEDs 230 are supplied power from the VAC 505, the DC voltage flows from the DC power disconnect test switch 170 to a charging circuit 520, which is then connected to the rechargeable internal battery 220. At this time, the internal battery 220 is recharged from the power provided by the VAC 505.

Further during normal operation when the DC power disconnect test switch 170 is closed and the LEDs 230 are supplied power from the VAC 505, the DC voltage flows from the DC power disconnect test switch 170 to a circuit breaker 525. The output of the circuit breaker 525 then goes through a current limiter 530, and then to the LEDs 230. In one exemplary embodiment, the function of the circuit breaker 525 is to provide power to the LEDs 230 when normal input DC voltage is present, but will automatically switch over to backup internal battery 220 DC power in the event of an input AC power failure.

In the event of an input AC power failure, the circuit breaker 525 trips so that DC voltage is supplied to the LEDs 230 from the internal battery 220. The DC voltage goes from the internal battery 220 through the switching mechanism 240, to the circuit breaker 525, through the current limiter 530, and then to the LEDs 230. In certain exemplary embodiments, the storage capacity of the internal battery 220 provides enough reserve voltage to power all of the LEDs 230 in the exit sign 100 for a duration of 1.5 to 3.0 hours when there is no AC voltage input. As previously mentioned, the purpose of the switching mechanism 240 is to allow the internal battery 220 to be installed within the exit sign and mechanically break the circuitry between the internal battery 220 and the circuit breaker 525 externally of the exit sign 100. When the circuitry between the internal battery 220 and the circuit breaker 525 is broken and the LEDs are not supplied power by the VAC 505, the internal battery 220 does not discharge.

Figure 6A:
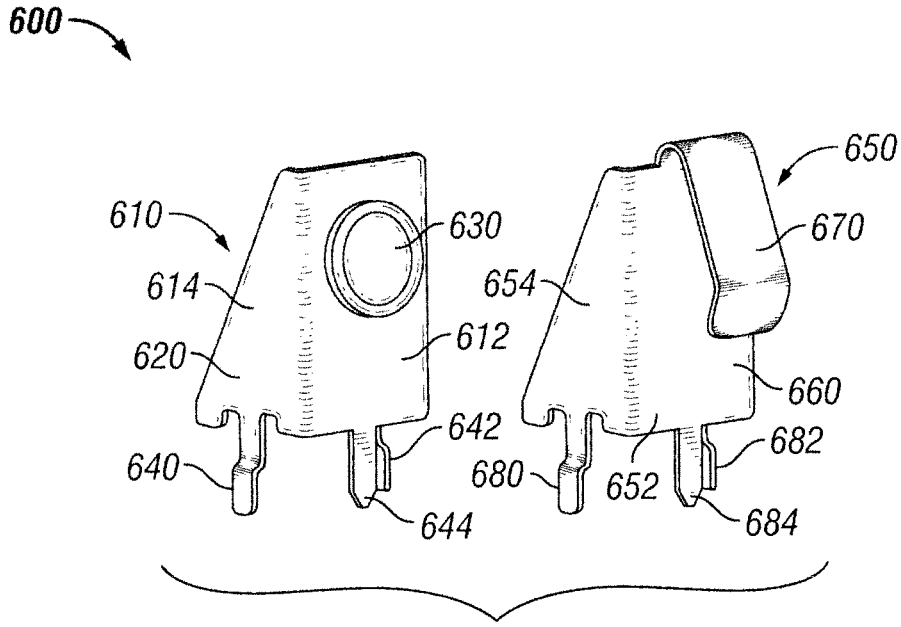
FIG. 6A is a perspective view of an alternative switching mechanism in accordance with another exemplary embodiment of the present invention.
Figure 6B:
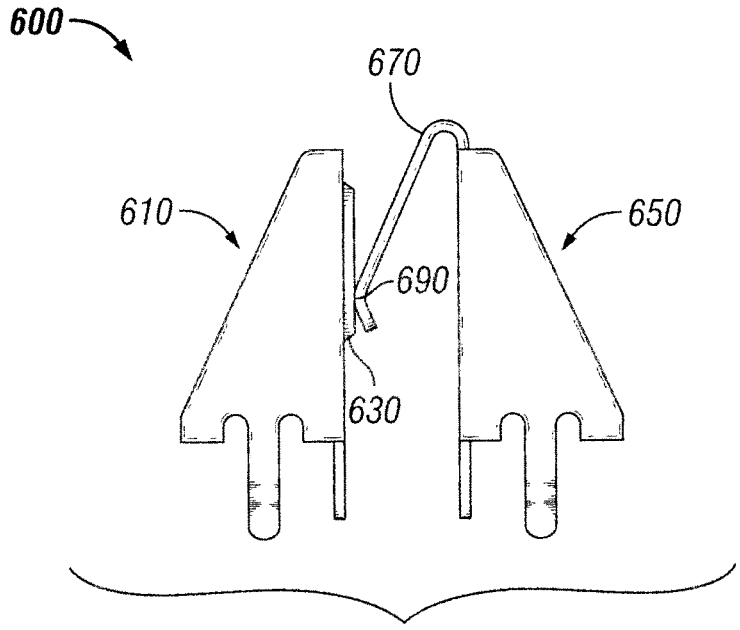
FIG. 6B is a side view of the switching mechanism of FIG. 6A in accordance with an exemplary embodiment of the present invention.

FIG. 6A is a perspective view of an alternative switching mechanism 600 in accordance with another exemplary embodiment of the present invention. FIG. 6B is a side view of the alternative switching mechanism 600 of FIG. 6A. Referring to FIGS. 6A and 6B, alternative switching mechanism 600 includes a button contact 610 and a leaf spring contact 650.

The button contact 610 includes a button contact housing 620, a button 630, a first leg 640, a second leg 642, and a third leg 644. In one exemplary embodiment, the button contact housing 620 is substantially rectangular when viewed from its front surface 612 and substantially triangular when viewed from its side surface 614. Alternatively the button contact housing 620 is capable of being formed in any geometric or non-geometric shape, including, but not limited to, square, circular, or triangular without departing from the scope and spirit of the exemplary embodiment. In one exemplary embodiment, the button contact housing 620 is fabricated from a conductive material including. Examples of potential conductive materials include, but are not limited to, metals and metal alloys.

The button 630 is substantially circular and is configured to protrude outwardly from the button contact housing front surface 612. Alternatively, the button 630 is made in other geometric or non-geometric shapes. In this exemplary embodiment, a recess is formed within the button 630. However, in alternative embodiments, the recess is optional. In certain exemplary embodiments, the button is integrally formed with the button contact housing 620. The exemplary button 630 is fabricated from a conductive material, examples of which include, but are not limited to, metals and metal alloys.

The first leg 640, second leg 642, and third leg 644 are coupled to the button contact housing 620. In one exemplary embodiment, the legs 640, 642, and 644 are fabricated using a conductive material, such as a metal. These legs 640, 642, and 644 are used to mount the button contact 610 to the circuit board 210 (FIG. 2A). In this exemplary embodiment, leg 644 also electrically couples the button contact 610 to a conductive trace (not shown) on the circuit board 210 (FIG. 2A). However, any of the legs are capable of electrically coupling the button contact 610 to the trace without departing from the scope and spirit of the exemplary embodiment. Additionally, the number of legs can be greater or less without departing from the scope and spirit of the exemplary embodiment.

The leaf spring contact 650 includes a leaf spring contact housing 660, a leaf spring 670, a first leg 680, a second leg 682, and a third leg 684. The leaf spring contact housing 660 is substantially rectangular when viewed from its front surface 652 and substantially triangular when viewed from its side surface 654. Although this exemplary embodiment depicts the leaf spring contact housing 660 being substantially rectangular when viewed from its front surface 652 and substantially triangular when viewed from its side surface 654, other alternative exemplary embodiments can have the leaf spring contact housing's 660 shape be any geometric shape, including, but not limited to, square, circular, or triangular without departing from the scope and spirit of the exemplary embodiment. The leaf spring contact housing 660 is fabricated from a conductive material including, but not limited to metals and metal alloys.

The leaf spring 670 is substantially chevron-shaped and is configured to protrude outwardly from the leaf spring contact housing's 660 front surface 652. The leaf spring 670 is integrally formed with the leaf spring contact housing 660. Although the leaf spring 670 is shown to be chevron-shaped, the leaf spring 670 can be any geometric shape, such as a curve-shape. The leaf spring 670 is fabricated from a conductive material including, but not limited to metals and metal alloys.

The first leg 680, the second leg 682, and the third leg 684 are coupled to the leaf spring contact housing 660. The legs 680, 682, and 684 are fabricated using a conductive material, such as a metal. These legs 680, 682, and 684 are used to mount the leaf spring contact 650 to the circuit board 210 (FIG. 2A). Leg 684 also is used to electrically couple the leaf spring contact 650 to a second conductive trace (not shown) on the circuit board (FIG. 2A). Although leg 684 is used to electrically couple the leaf spring contact 650 to a second conductive trace (not shown) on the circuit board 210 (FIG. 2A), any of the legs can be used to electrically couple the leaf spring contact 650 to the second trace without departing from the scope and spirit of the exemplary embodiment. Additionally, although three legs are used in this embodiment, the number of legs can be greater or less without departing from the scope and spirit of the exemplary embodiment.

When mounting the button contact 610 and the leaf spring contact 650 to the circuit board 210 (FIG. 2A), the front surface 612 of the button contact 610 faces the front surface 652 of the leaf spring contact 650. The button contact 610 and the leaf spring contact 650 are mounted in close proximity to one another so that the leaf spring 670 is contacting the button 630 to form a connection point 690, as shown in FIG. 6B. Thus, when the mechanical disconnect male jack's 190 (FIG. 2B) plug end 192 (FIG. 2B) is inserted between the button contact 610 and the leaf spring contact 650, the electrical contact between the leaf spring 670 and the button 630 is broken. In other words, the connection point 670 is eliminated. However, when the mechanical disconnect male jack's 190 (FIG. 2B) plug end 192 (FIG. 2B) is removed from between the button contact 610 and the leaf spring contact 650, the electrical contact between the leaf spring 670 and the button 630 is restored. In other words, the connection point 670 is reformed. The mechanical disconnect male jack's 190 (FIG. 2B) can be a piece of paper, piece of cardboard, or any other non-conducting material that is insertable between the button contact 610 and the leaf spring contact 650.

Figure 7A:
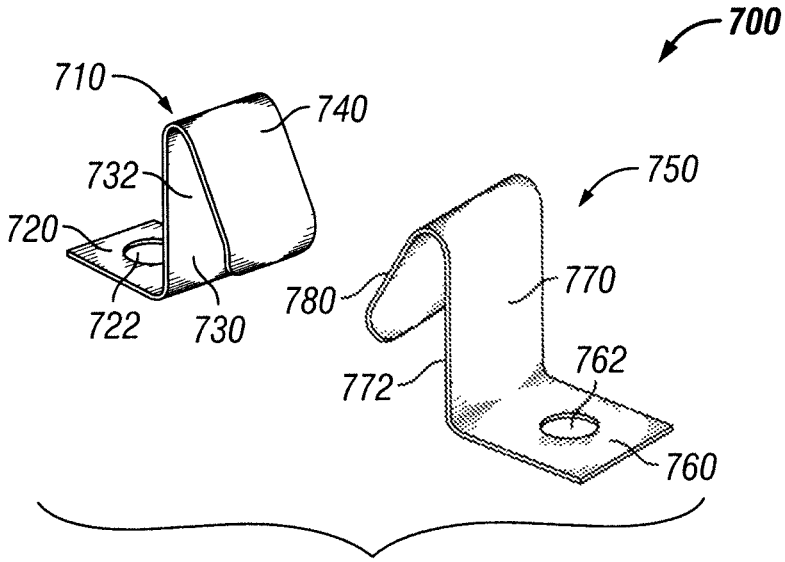
FIG. 7A is a perspective view of a second alternative switching mechanism in accordance with yet another exemplary embodiment of the present invention.
Figure 7B:
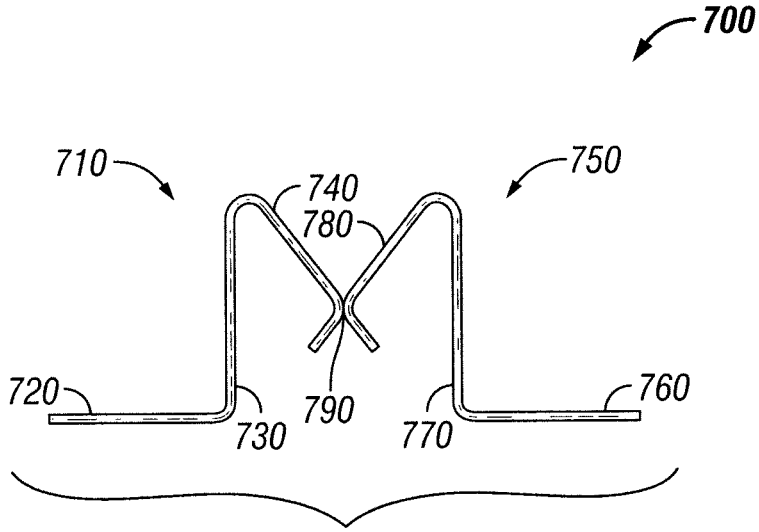
FIG. 7B is a side view of the switching mechanism of FIG. 7A in accordance with an exemplary embodiment of the present invention.

FIGS. 7A and 7B are views of a second alternative switching mechanism 700 in accordance with yet another exemplary embodiment of the present invention. Now referring to FIGS. 7A and 7B, the second alternative switching mechanism 700 includes a first leaf spring contact 710 and a second leaf spring contact 750.

The first leaf spring contact 710 includes a base 720, a vertical transition 730, and a leaf spring 740. The base 720 is substantially planar and includes an opening 722 for allowing the base 720 to be surface mounted onto the circuit board 210 (FIG. 2A). The base 720 is substantially rectangular when viewed from above. Although this exemplary embodiment depicts the base 720 being substantially rectangular when viewed from above, other alternative exemplary embodiments can have the base 720 be any geometric shape, including, but not limited to, square, circular, or triangular without departing from the scope and spirit of the exemplary embodiment. The base 720 is fabricated from a conductive material including, but not limited to metals and metal alloys.

The vertical transition 730 is substantially planar and is oriented substantially perpendicular in one direction to the base 720. The vertical transition 730 is substantially rectangular when viewed from the front surface 732 of the vertical transition 730. Although this exemplary embodiment depicts the vertical transition 730 being substantially rectangular when viewed from the front surface 732, other alternative exemplary embodiments can have the vertical transition 730 be any geometric shape, including, but not limited to, square, circular, or triangular without departing from the scope and spirit of the exemplary embodiment. The vertical transition 730 is fabricated from a conductive material including, but not limited to metals and metal alloys. Typically, the vertical transition 730 is fabricated integrally to the base 720. Although the vertical transition 730 is depicted as being substantially perpendicular to the base 720, the vertical transition 730 can be angular to the base 720 without departing from the scope and spirit of the exemplary embodiment.

The leaf spring 740 is substantially chevron-shaped and is configured to protrude outwardly from the upper edge of the vertical transition's 730 front surface 732. The leaf spring 740 is integrally formed with the vertical transition 730. Although the leaf spring 740 is shown to be chevron-shaped, the leaf spring 740 can be any geometric shape, such as a curve-shape. The leaf spring 740 is fabricated from a conductive material including, but not limited to metals and metal alloys.

Similarly, the second leaf spring contact 750 includes a base 760, a vertical transition 770, and a leaf spring 780. The base 760 is substantially planar and includes an opening 762 for allowing the base 760 to be surface mounted onto the circuit board 210 (FIG. 2A). The base 760 is substantially rectangular when viewed from above. Although this exemplary embodiment depicts the base 760 being substantially rectangular when viewed from above, other alternative exemplary embodiments can have the base 760 be any geometric shape, including, but not limited to, square, circular, or triangular without departing from the scope and spirit of the exemplary embodiment. The base 760 is fabricated from a conductive material including, but not limited to metals and metal alloys.

The vertical transition 770 is substantially planar and is oriented substantially perpendicular in one direction to the base 760. The vertical transition 770 is substantially rectangular when viewed from the front surface 772 of the vertical transition 770. Although this exemplary embodiment depicts the vertical transition 770 being substantially rectangular when viewed from the front surface 772, other alternative exemplary embodiments can have the vertical transition 770 be any geometric shape, including, but not limited to, square, circular, or triangular without departing from the scope and spirit of the exemplary embodiment. The vertical transition 770 is fabricated from a conductive material including, but not limited to metals and metal alloys. Typically, the vertical transition 770 is fabricated integrally to the base 760. Although the vertical transition 770 is depicted as being substantially perpendicular to the base 760, the vertical transition 770 can be angular to the base 760 without departing from the scope and spirit of the exemplary embodiment.

The leaf spring 780 is substantially chevron-shaped and is configured to protrude outwardly from the upper edge of the vertical transition's 770 front surface 772. The leaf spring 780 is integrally formed with the vertical transition 770. Although the leaf spring 780 is shown to be chevron-shaped, the leaf spring 780 can be any geometric shape, such as a curve-shape. The leaf spring 780 is fabricated from a conductive material including, but not limited to metals and metal alloys.

When mounting the first leaf spring contact 710 and the second leaf spring contact 750 to the circuit board 210 (FIG. 2A), the front surface 732 of the first leaf spring contact's 710 vertical transition 730 faces the front surface 772 of the second leaf spring contact's 750 vertical transition 770. The first leaf spring contact 710 and the second leaf spring contact 750 are mounted in close proximity to one another and facing one another so that the first leaf spring contact's 710 leaf spring 740 is contacting the second leaf spring contact's 750 leaf spring 780 to form a connection point 790, as shown in FIG. 7B. Thus, when the mechanical disconnect male jack's 190 (FIG. 2B) plug end 192 (FIG. 2B) is inserted between the first leaf spring contact's 710 leaf spring 740 and the second leaf spring contact's 750 leaf spring 780, the electrical contact between the leaf spring 740 and the leaf spring 780 is broken. In other words, the connection point 790 is eliminated. However, when the mechanical disconnect male jack's 190 (FIG. 2B) plug end 192 (FIG. 2B) is removed from between the first leaf spring contact 710 and the second leaf spring contact 750, the electrical contact between the leaf spring 740 and the leaf spring 780 is restored. In other words, the connection point 790 is reformed. The mechanical disconnect male jack's 190 (FIG. 2B) can be a piece of paper, piece of cardboard, or any other non-conducting material that is insertable between the first leaf spring contact 710 and the second leaf spring contact 750.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A lighting device, comprising:

a housing comprising:

a battery positionable within the housing;

a switching mechanism electrically coupled to the battery; and one or more light sources electrically coupled to the battery through the switching mechanism, wherein the switching mechanism receives a removable component that electrically disconnects the one or more light sources from the battery.

2. The lighting device of claim 1, wherein the switching mechanism is normally closed.

3. The lighting device of claim 1, wherein the switching mechanism comprises a first contact and a second contact.

4. The lighting device of claim 1, wherein the switching mechanism is selected from a group consisting of a mono audio jack, a phone jack, a button contact and a leaf spring contact, and a first leaf spring contact and a second leaf spring contact.

5. The lighting device of claim 1, wherein at least a portion of the removable component is fabricated from a non-conductive material.

6. The lighting device of claim 5, wherein the non-conductive material is selected from one of plastic, paper, wood, or fish paper.

7. The lighting device of claim 1, wherein the removable component is releasably coupled to the switching mechanism.

8. A lighting device, comprising:

a housing comprising:

a battery disposed within the housing;

a switching mechanism electrically coupled to the battery, the switching mechanism comprising a button contact and a leaf spring contact, the leaf spring contact being positioned in separable contact with the button contact at a connection point; and one or more light sources electrically coupled to the battery through the switching mechanism, wherein the switching mechanism slidably receives a mechanical disconnect at the connection point to electrically disconnect the button contact from the leaf spring contact and the one or more light sources from the battery.

9. The lighting device of claim 8, wherein the switching mechanism is normally closed.

10. The lighting device of claim 8, wherein the leaf spring contact comprises a leaf spring contact housing and a leaf spring, the leaf spring protruding outwardly beyond a front surface of the leaf spring contact housing.

11. The lighting device of claim 10, wherein the leaf spring is in separable contact with the button contact.

12. The lighting device of claim 8, wherein at least a portion of the mechanical disconnect is fabricated from a non-conductive material.

13. The lighting device of claim 8, wherein the mechanical disconnect is capable of being inserted and removed from the switching mechanism repeatedly.

14. A method for installing a lighting device, comprising:

mounting the lighting device onto a mounting structure, wherein the lighting device comprises:

a housing comprising:

a battery disposed within the housing, the battery providing a back-up power source;

a switching mechanism electrically coupled to the battery; and one or more light sources electrically coupled to the battery through the switching mechanism; and an external mechanical disconnect releasably coupled to the switching mechanism;

electrically coupling the lighting device to an external power source; and removing the external mechanical disconnect from the switching mechanism to enable operation of the back-up power source.

15. The method of claim 14, wherein the housing further comprises a circuit breaker electrically coupled to the battery through the switching mechanism, wherein the switching mechanism comprises a first contact and a second contact disposed therein, and wherein removal of the external mechanical disconnect from the switching mechanism electrically couples the first contact to the second contact and allows power to flow from the battery to the circuit breaker.

16. The method of claim 14, wherein external mechanical disconnect is releasably coupled to the switching mechanism through an opening formed along a surface of the housing.

17. The method of claim 14, wherein the switching mechanism is selected from one of a mono audio jack, a phone jack, a combination comprising a button contact and a leaf spring contact, and a combination comprising a first leaf spring contact and a second leaf spring contact.

18. The method of claim 14, wherein at least a portion of the external mechanical disconnect is fabricated from a non-conductive material.

19. The method of claim 14, further comprising pressing a power disconnect test switch to simulate interruption of power supplied from the external power source, thereby activating the back-up power source to supply power to the light sources.

20. The method of claim 19, further comprising determining that the back-up power source is operating properly if the light sources are on immediately after the power disconnect switch is pressed.

* * * * *